United States Patent [19]

Matsudo et al.

[11] 4,019,929

[45] Apr. 26, 1977

[54] ENAMELING COLD ROLLED STEEL SHEET WITH A HIGH ENAMEL ADHESIVE PROPERTY

[75] Inventors: Kazuo Matsudo; Takayoshi Shimomura; Teruo Kurokawa; Takao Arayama, all of Fukuyama, Japan

[73] Assignee: Nippon Kokan Kabushiki Kaisha, Tokyo, Japan

[22] Filed: May 20, 1975

[21] Appl. No.: 579,231

[30] Foreign Application Priority Data

June 24, 1974 Japan ..... 49-71381

[52] U.S. Cl. ..... 148/31.5; 148/36

[51] Int. Cl.[2] ..... C22C 38/04

[58] Field of Search ..... 148/31.5, 31, 36; 29/527.1, 193, 527.2

[56] References Cited

UNITED STATES PATENTS

| | | | |
|---|---|---|---|
| 2,065,392 | 12/1936 | Porter et al. | 148/36 X |
| 2,109,271 | 2/1938 | Krause | 428/457 |
| 2,602,034 | 7/1952 | Eckel | 148/134 |
| 2,878,151 | 3/1959 | Beall et al. | 148/31.5 |
| 3,282,685 | 11/1966 | Mayer et al. | 75/125 |
| 3,368,886 | 2/1968 | Muta et al. | 75/125 |
| 3,436,808 | 4/1969 | Kotyk | 148/16 |
| 3,704,181 | 11/1972 | Nishihara et al. | 148/31.5 |
| 3,879,232 | 4/1975 | Gondo et al. | 148/12 C |
| 3,912,549 | 10/1975 | Gondo et al. | 148/12 C |

*Primary Examiner*—Arthur J. Steiner
*Attorney, Agent, or Firm*—Flynn & Frishauf

[57] ABSTRACT

An enameling cold rolled steel sheet with a high enamel adhesive property which requires no pickling step before enameling, characterized by an Mn content kept within 0.05 to 0.20%, and the relation between the surface roughness and the Mn content of said steel sheet satisfying at least one of the following two equations:

(a) Number of peaks of $1.3\mu$ and over/inch $\geqq 1{,}200 \cdot (Mn\% - 0.1)$ (b) $R_z\ (\mu) \geqq 60 \cdot (Mn\% - 0.1)$

8 Claims, 6 Drawing Figures

ENAMELING COLD ROLLED STEEL SHEET WITH A HIGH ENAMEL ADHESIVE PROPERTY

FIELD OF THE INVENTION

This invention relates to an enameling cold rolled steel sheet with a high enamel adhesive property which permits enameling after application of a very slight pickling or by totally omitting pickling.

BACKGROUND OF THE INVENTION

The prior art enameling of cold rolled steel sheet comprises the following steps: material sheet → shaping the sheet → degreasing → pickling → Ni-dipping, if necessary → neutralization → drying → application of enamel → drying → baking. When one coat of enamel is to be applied to the material sheet consisting of an enameling steel sheet produced by decarburization-annealing, vacuum degassing, etc., the above-mentioned steps are all those required for producing a product enameled steel sheet. When two or more coats of enamel are to be applied to the material sheet, the steps of application of enamel, drying and baking are further repeated to produce a product enameled steel sheet.

In such enameling processes, the pickling step is indispensable for a good enamel adherence to the steel sheet, and it is said that pickling with a pickling steel loss of 20 g/m$^2$ or more is required for obtaining a high enamel adhesive property. For this reason, the following methods have been proposed to obtain a high enamel adhesive property.

1. When a sufficient pickling steel loss to obtain a high enamel adhesive property cannot be obtained by using an existing pickling facility or a conventional pickling method: a method of adjusting the chemical composition of steel sheet by adding phosphorus or limiting the Cu content to achieve a desired pickling steel loss (e.g., U.S. Pat. No. 3,436,808, U.S. Pat. No. 3,282,685).

2. A method of pickling in combination with Ni-dipping, i.e., Ni-flashing, comprising dipping a pickled steel sheet in a several percent nickel sulfate aqueous solution and causing nickel to be precipitated on the steel surface, in order to make up for the insufficient enamel adhesive property obtained by pickling.

3. A method of improving the kind of acids and the composition of pickling baths used for pickling.

The above-mentioned methods all require a pickling step, thus presenting the following problems:

a. Since the concentration and temperature of a pickling bath have substantial effect on the enamel adhesive property of a steel sheet, strict control of the pickling bath is necessary for obtaining a desired enamel adhesive property. This control is however very difficult.

b. The need of the pickling step leads to an increase in cost of enameling operation and is an obstacle to the improvement in the efficiency of enameling operation. Further, the pickling bath is a source of environmental pollution and worsens the work environment.

c. Pickling tends to cause defects such as blister formed on the enameled products.

In consideration of the foregoing, cold rolled steel sheets capable of giving a high enamel adhesive property even with total ommission of the pickling step or with pickling performed only to the slightest degree. Such cold rolled steel sheets have not however as yet been proposed.

SUMMARY OF THE INVENTION

Therefore, an object of this invention is to provide an enameling cold rolled steel sheet which is capable of giving a high enamel adhesive property even if the pickling step before enameling is totally omitted.

Especially, a principal object of this invention is to provide an enameling cold rolled steel sheet with a high enamel adhesive property which totally eliminates the necessity of the pickling step before enameling, the relation between the surface roughness and the Mn content of said steel sheet satisfying given equations.

Another object of this invention is to provide an enameling cold rolled steel sheet which can be produced with a high efficiency of enameling operation and at a low cost.

Still another object of this invention is to provide an enameling cold rolled steel sheet which does not cause defects such as blister formed on the enameled product.

The enameling cold rolled steel sheet of this invention is characterized by an Mn content kept within 0.05 to 0.20%, and the relation between the surface roughness and the Mn content of said steel sheet satisfying at least one of the following two equations, such steel sheet being capable of giving a high enamel adhesive property even with total omission of the pickling step before enameling:

(a) Number of peaks of 1.3$\mu$ and over/inch $\geqq 1{,}200 \cdot (\text{Mn\%} - 0.1)$ (b) $R_z\ (\mu) \geqq 60 \cdot (\text{Mn\%} - 0.1)$

DETAILED DESCRIPTION OF PREFERRED EMBODIMENTS

Figure 1:
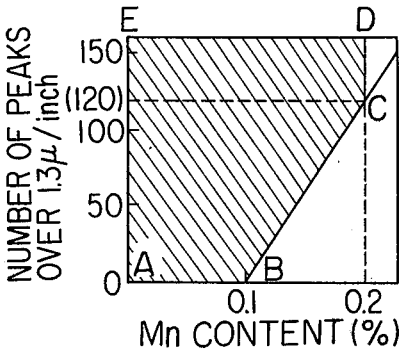
FIGS. 1 and 2 are diagrams which illustrate the relation between the Mn content and the surface roughness of an enameling cold rolled steel sheet of this invention.

As a result of many years' study, it has been found that a cold rolled steel sheet can be enameled with a good enamel adherence even if the pickling step before enameling is performed to the slightest degree or totally omitted, on condition that the Mn content of said cold rolled steel is less than 0.20%, preferably more than 0.05% and less than 0.2%, and further that the relation between the surface roughness and the Mn content of said steel sheet is within at least one of the following ranges, or satisfies at least one of the following equations:

The range formed by connecting points A,B,C,D and E shown in FIG. 1, namely:

$$\text{Number of peaks of } 1.3\mu \text{ and over/inch} \geqq 1{,}200 \cdot (\text{Mn\%} - 0.1) \quad (1)$$

Figure 2:
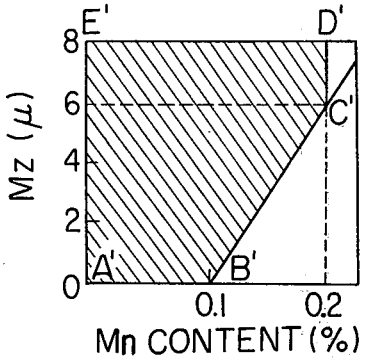

The range formed by connecting points A′,B′,C′,D′ and E′ shown in FIG. 2, namely:

$$R_z\ (\mu) \geqq 60 \cdot (\text{Mn\%} - 0.1) \quad (2)$$

The number of peaks of 1.3$\mu$ and over/inch in Eq. (1) is one of the methods of indicating surface roughness. The method of counting the number of peaks of 1.3$\mu$ and over/inch is described with reference to FIG. 6.

Figure 6:
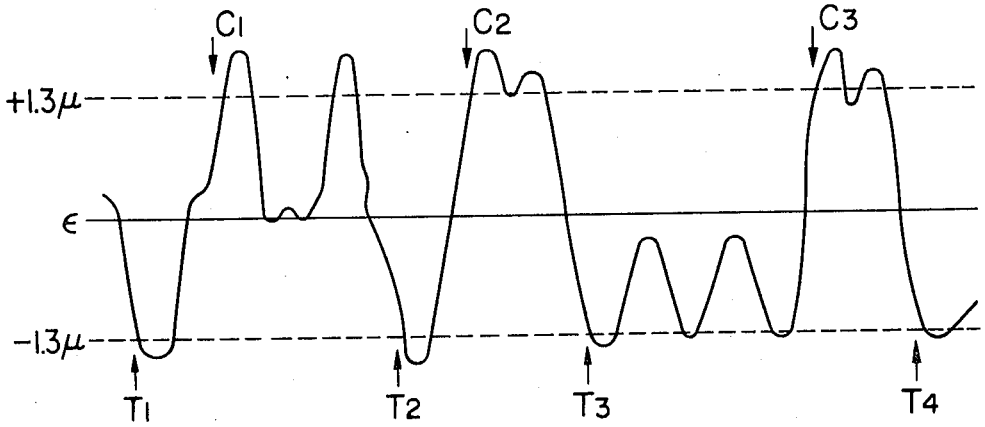
FIG. 6 is a diagram which illustrates a method of measuring the surface roughness of steel sheets.

In FIG. 6, the curve represents the profile of a measured surface, and $\epsilon$ is the reference line, i.e., the straight line showing the mean value of the peaks and throughs of said curve. The upper dotted line parallel to said reference line $\epsilon$ represents the maximum of +1.3$\mu$, and the lower dotted line parallel to said reference line $\epsilon$ represents the minimum of −1.3$\mu$. When a peak of said curve exceeds the maximum of +1.3$\mu$ between point $T_1$ where a trough of said curve is below the minimum of −1.3$\mu$ and the next point $T_2$ where another trough of said curve is below the minimum of −1.3$\mu$, the number of peaks is counted as 1. However, the number of peaks would also be 1, no matter how many peaks of said curve may exceed the maximum of +1.3$\mu$ between points $T_1$ and $T_2$. For example, although two peaks of said curve exceed the maximum of +1.3$\mu$ between points $T_1$ and $T_2$ in this diagram, the counted number of peaks is 1. Similarly, when still another peak of said curve exceeds the maximum of +1.3$\mu$ between the following point $T_3$ where still another trough of said curve is below the minimum of −1.3$\mu$ and the preceding point $T_2$, one is added as the number of peaks between points $T_2$ and $T_3$. In this manner, the number of peaks within the reference length of 1 inch from point $T_1$ is counted.

As is apparent from the above explanation, supposing in FIG. 6 the measured distance between points $T_1$ and $T_4$ is 1 inch, $C_1$, $C_2$ and $C_3$ are counted as the number of peaks. Therefore, the number of peaks of 1.3$\mu$ and over/inch in said Eq. (1) is 3.

$R_z$ in Eq. (2) is another method for representing the surface roughness, and has been instituted as Japan Industrial Standard JIS-B 0601 in 1970. Said $R_z$ is calculated by: extracting a length corresponding to the reference length from the curve showing the profile of a measured surface; determining the reference line, i.e., the mean line, of the peaks and troughs of said curve in said length extracted; selecting the third highest straight line and the third lowest line from among the straight lines passing the highest points of peaks and the lowest points of troughs parallel to said reference line and measuring the distance between said two straight lines; and indicating the value obtained by dividing said distance by the longitudinal magnification in $\mu$. Values measured with this $R_z$ show no significant differences from those measured by ISO (International Standardization Organization) R468, an internationally used method for representing the surface roughness.

Figure 3:
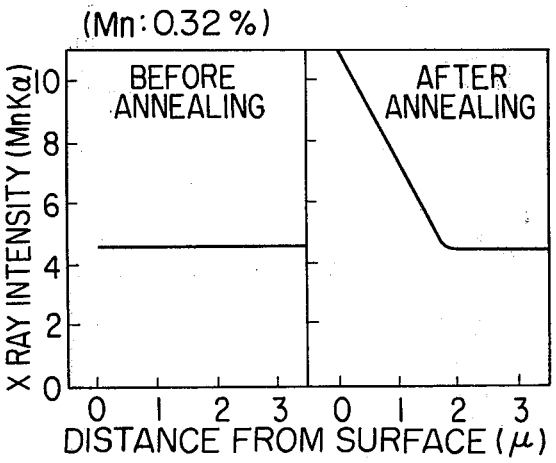
FIGS. 3, 4 and 5 are diagrams which illustrate the Mn distribution toward the surface of steel sheets before and after annealing.

The reason why the Mn content of the cold rolled steel sheet of this invention is limited to less than 0.20% is as follows. For example, FIG. 3 shows a comparison of the Mn distributions near the surface of the cold rolled steel sheet with an Mn content of 0.32% before and after annealing. As is shown in the diagram, when the Mn content of the steel sheet exceeds 0.20%, Mn is concentrated in the surface of the steel sheet by annealing. Since such a steel sheet which has an Mn concentration in the surface has a very low enamel adhesive property, the surface of said steel sheet must be prepared exceedingly rough for enameling, without a pickling step.

Figure 4:
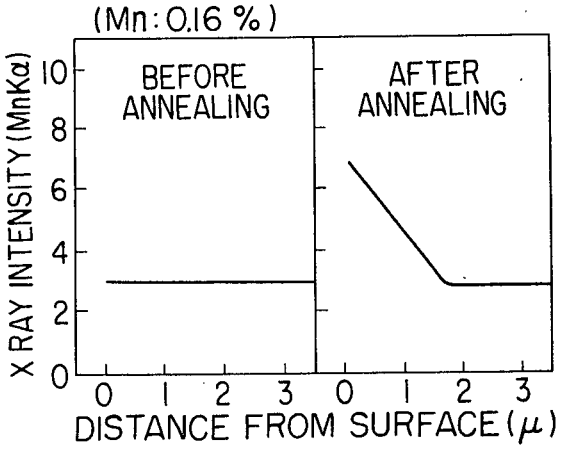

On the other hand, when the Mn content of a steel sheet is less than 0.20%, the tendency toward concentration of Mn in the surface of the steel sheet becomes smaller in proportion to the Mn content. For example, as shown in FIG. 4, when the Mn content of a steel sheet is 0.16%, the tendency toward concentration of Mn in the surface of the steel sheet is considerably smaller than in the case of an Mn content of 0.32% mentioned above. Therefore, in this case, a high enamel adhesive property can be obtained without the need of pickling only if a proper roughness is given to the steel sheet. This is due to the fact that the surface roughness of said steel sheet improves the chemical bonding strength by increasing the reaction area, i.e., the contact area, between the enamel and the steel sheet, and that the surface roughness of said steel sheet improves also the mechanical bonding strength by increasing the number of anchor points, thereby permitting enameling with good adherence even without activation and roughening of the steel sheet by pickling.

However, the minimum surface roughness of the steel sheet which enables the pickling step to be omitted is not uniform even in a steel sheet having an Mn content of less than 0.20%. It varies with the Mn content of the steel sheet as shown in FIGS. 1 and 2, that is, a steel sheet may have a smaller minimum surface roughness as the Mn content of the steel sheet becomes lower. Although the reason is not as yet theoretically explained, it is considered that the enamel adhesive property deteriorates with the increase in Mn content in the surface of the steel sheet.

Figure 5:
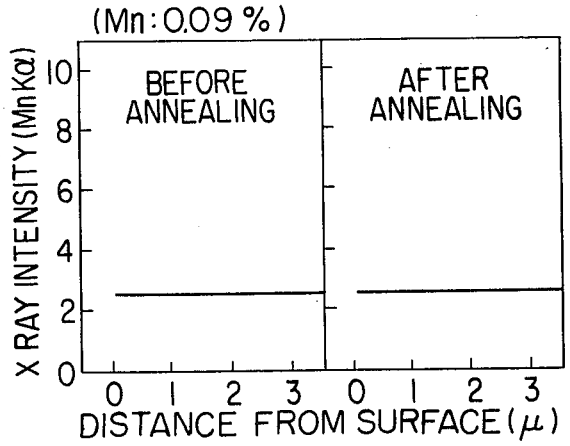

FIG. 5 shows a comparison of the Mn distributions near the surface of a steel sheet before and after annealing of the cold rolled steel sheet with an Mn content of 0.09%. As shown in the diagram, when the Mn content of the steel is lower than 0.10%, the concentration of Mn in the surface of the steel sheet by annealing is non-existent. In addition, since in this case with a low Mn content, a high enamel adhesive property can be obtained without pickling enen if the steel surface is not specifically roughened. However, the surface of a steel sheet is more liable to be scratched on handling or processing when it is made smooth. In this respect, it is quite permissible to roughen the surface of the steel sheet to a degree more than required. Therefore, so far as the enamel adhesive property is concerned, it is unnecessary to limit the minimum of the Mn content of the steel sheet, and if the Mn content of a steel sheet is less than 0.20% and the relation between the surface roughness and the Mn content of the steel sheet satisfies at least one of the abovementioned equations (1) and (2), that suffices to obtain a good adherence. However, for the purpose of preventing the steel sheet from becoming brittle on production, especially on hot rolling, of the steel sheet, the Mn content of the steel sheet is preferably more than 0.05%.

The above paragraphs have described in detail the reason why the Mn content of the enameling cold rolled steel sheet of this invention is limited to more than 0.05% and less than 0.20%.

It is unnecessary to limit the chemical constituents other than Mn and production methods of the enameling cold rolled steel sheet of this invention. Among enameling cold rolled steel sheets are: a steel sheet containing less than 0.10% C and less than 0.20% Mn as basic constituents and another steel sheet containing P, Ti, etc. in appropriate quantities as required in addition to C and Mn in said quantities, both used mainly for application of two or more coats of enamel, and a steel sheet containing C reduced to an amount of less than 0.02% by vacuum degassing or decarburization-annealing to avoid a bubbling during baking and another steel sheet containing P, Ti, Nb, etc. in appropriate quantities in addition to C in said quantity to prevent fish-scale defects and at the same time to increase the pickling speed, both used mainly for application of one coat of enamel. This invention is applicable to all of these steel sheets.

Further, the roughening of the surface of the cold rolled steel sheet of this invention can be performed either during cold rolling or skin pass rolling of the steel sheet, or it may be performed in both steps. It is unnecessary to limit the roughening.

Next, this invention is described in more detail in reference to an embodiment.

EXAMPLE

Rimmed hot rolled steel sheets A, B and C with Mn contents within the scope of this invention and compositions shown in Table 1 and rimmed hot steel sheets D and E with Mn contents outside the scope of this invention and compositions shown in Table 1 were produced. Said rimmed hot rolled steel sheets A to E were subjected to a process comprising the steps of pickling, cold rolling, annealing and skin pass rolling to produce cold rolled steel sheets. In both steps of said cold rolling and said skin pass rolling, roughening of the surface of steel sheets was effected to produce cold rolled steel sheets No. 1 to No. 11 with different surface roughnesses. Said cold rolled steel sheets No. 1 to No. 11 were then subjected to alkali degreasing without performing pickling, and then commercial enamel was sprayed on the surface of said cold rolled steel sheets to produce coatings of enamel with thicknesses between about 80$\mu$ and about 100$\mu$. Subsequently, these steel sheets were baked at 850° C for about 3 minutes after drying. Enameled cold rolled steel sheets No. 1 to No. 11 thus obtained were subjected to P.E.I. test which is world-widely adopted for enamel adhesive property test. (This testing method is disclosed in the specification of the above-mentioned U.S. Pat. No. 3,232,685.) Results of the test are shown in Table 2.

Table 1

| Steel Grade | Chemical Composition (%) C | Si | Mn | P | S |
|---|---|---|---|---|---|
| A | 0.044 | tr | 0.09 | 0.012 | 0.010 |
| B | 0.051 | tr | 0.16 | 0.010 | 0.015 |
| C | 0.055 | tr | 0.20 | 0.013 | 0.016 |
| D | 0.050 | tr | 0.24 | 0.011 | 0.013 |
| E | 0.046 | tr | 0.33 | 0.009 | 0.011 |

Table 2

| Sheet No. | Steel Grade | Mn Content (%) | $R_2$ ($\mu$) | Number of peaks of 1.3$\mu$ and over/inch | Enamel adhesive property (P.E.I. adherence index) (%) |
|---|---|---|---|---|---|
| 1 | | | 0.8* | 15* | 100 |
| | A | 0.09 | | | |
| 2 | | | 5.0* | 107* | 100 |
| 3 | | | 2.0 | 34 | 76 |
| 4 | B | 0.16 | 4.0* | 88* | 100 |
| 5 | | | 5.0* | 63 | 100 |
| 6 | | | 3.0 | 128* | 100 |
| | C | 0.20 | | | |
| 7 | | | 5.0 | 78 | 68 |
| 8 | | | 5.5 | 141 | 85 |
| | D | 0.24 | | | |
| 9 | | | 6.0 | 121 | 79 |
| 10 | | | 5.0 | 134 | 72 |
| | E | 0.33 | | | |
| 11 | | | 6.0 | 146 | 83 |

As shown in Table 2, steel sheets marked * which have an Mn content of less than 0.20% and in which the relation between the surface roughness and the Mn content satisfies at least one of the above-mentioned equations (1) and (2), i.e., cold rolled steel sheets Nos. 1, 2, 4, 5 and 6 within the scope of this invention, show an excellent enamel adhesive property even with total omission of the pickling step before enameling.

As amplified above, the enameling steel sheet of this invention possesses an excellent enamel adhesive property even with total omission of the pickling step before enameling, which poses various problems, thus producing an industrially useful effect.

What is claimed is:

1. A cold rolled steel sheet having a Mn content within the range of 0.05 to 0.2 percent by weight, characterized by being obtained by the sequence of steps of preparing said cold rolled steel sheet and degreasing said sheet, and by the relationship between the surface roughness of said sheet and the Mn content thereof satisfying at least one of the following two equations:

(a) Number of peaks of 1.3$\mu$ and over per inch $\geqq 1{,}200 \cdot (Mn\% - 0.1)$, (b) Rz, in $\mu$, $\geqq 60 \cdot (Mn\% - 0.1)$, wherein Rz is defined by JIS-B 0601, said steel sheet capable of being enameled without prior pickling and when enameled having a P.E.I. Adherence Index of at least 68 percent.

2. The cold rolled steel sheet of claim 1, wherein the sheet is degreased with an alkali.

3. The cold rolled steel sheet of claim 1, wherein the said relationship is defined by (a).

4. The cold rolled steel sheet of claim 1, wherein the said relationship is defined by (b).

5. The cold rolled steel sheet of claim 1, containing, in percent by weight:

| | |
|---|---|
| carbon | 0.044 |
| manganese | 0.09 |
| phosphorus | 0.012 |
| sulfur | 0.010. |

6. The cold rolled steel sheet of claim 1, containing, in percent by weight:

| | |
|---|---|
| carbon | 0.051 |
| manganese | 0.16 |
| phosphorus | 0.01 |
| sulfur | 0.015. |

7. The cold rolled steel sheet of claim 1, containing, in percent by weight:

| | |
|---|---|
| carbon | 0.055 |
| manganese | 0.20 |
| phosphorus | 0.013 |
| sulfur | 0.016. |

8. The cold rolled steel sheet of claim 1 containing an enamel thereon.

* * * * *

UNITED STATES PATENT AND TRADEMARK OFFICE

CERTIFICATE OF CORRECTION

PATENT NO. : 4,019,929

DATED : April 26, 1977

INVENTOR(S) : KAZUO MATSUDO et al

It is certified that error appears in the above-identified patent and that said Letters Patent are hereby corrected as shown below:

In the Drawings, Fig. 2, ordinate: replace "$M_Z$" with --- $R_Z$ ---.

Column 3, line 10: replace "throughs" with --- troughs ---.

Column 4, line 40: replace "enen" with --- even ---.

Column 5, Table 2, in the heading: replace "$R_2$" with --- $R_Z$ ---.

Column 6, Table 2 continued, in the heading: replace "$R_2$" with --- $R_Z$ ---.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*